US006295824B1

(12) United States Patent
Katayama

(10) Patent No.: US 6,295,824 B1
(45) Date of Patent: Oct. 2, 2001

(54) SNOW PRODUCING SYSTEM IN WHICH MELTWATER IS REUSED

(75) Inventor: Minoru Katayama, Hiroshima (JP)

(73) Assignee: Kabushiki Kaisha Piste Snow Industries (JP)

( * ) Notice: Subject to any disclaimer, the term of this patent is extended or adjusted under 35 U.S.C. 154(b) by 0 days.

(21) Appl. No.: 09/488,093

(22) Filed: Jan. 18, 2000

(51) Int. Cl.[7] ..... A63C 19/10
(52) U.S. Cl. ..... 62/235; 62/320; 62/348
(58) Field of Search ..... 62/235, 320, 348, 62/347, 354

(56) References Cited

U.S. PATENT DOCUMENTS

| | | | | |
|---|---|---|---|---|
| 2,878,651 | * | 3/1959 | Heinzelman | 62/235 |
| 2,955,437 | * | 10/1960 | Nilsson | 62/235 |
| 3,654,770 | * | 4/1972 | Clearman | 62/348 |
| 3,986,342 | * | 10/1976 | MacCraken | 62/235 |
| 4,345,439 | * | 8/1982 | Gundlach | 62/320 |
| 5,241,830 | * | 9/1993 | Morioka et al. | 62/235 |
| 5,272,883 | | 12/1993 | Matsui et al. | 62/74 |
| 5,381,668 | * | 1/1995 | Morioka | 62/235 |

FOREIGN PATENT DOCUMENTS

| | | |
|---|---|---|
| 0 971 185 A1 | 1/2000 | (EP) . |
| 2325298 | 11/1998 | (GB) . |
| 06018134 | 1/1994 | (JP) . |
| 7-239164 | 9/1995 | (JP) . |
| 08240367 | 9/1996 | (JP) . |

* cited by examiner

*Primary Examiner*—William E. Tapolcal
(74) *Attorney, Agent, or Firm*—Knoble & Yoshiba, LLC

(57) ABSTRACT

A system comprises a facility for which snow is used, a snow producing unit for producing snow from water, and a collection section for collecting meltwater and supplies the collected meltwater to the snow producing unit as water used for producing snow. According to such a system, since snow is again produced from meltwater and used, artificial snow can be supplied to a facility for which artificial snow is used without using a large amount of water.

7 Claims, 6 Drawing Sheets

SNOW PRODUCING SYSTEM IN WHICH MELTWATER IS REUSED

BACKGROUND OF THE INVENTION

1. Field of the Invention

The present invention relates to a snow producing system used for facilities such as a skiing ground, a snowboarding ground, and the like for which artificial snow is used.

2. Description of the Related Art

To solve the shortage of snow at facilities such as a skiing ground and a snowboarding ground for which natural snow is used, or to produce artificial snow at a facility in which artificial snow is sprayed over an artificially formed inclined surface, an artificial snow producing machine is used.

A large amount of water is necessary to produce snow, and tap water, river water, ground water or the like is usually used as water used for producing snow. Therefore, it is difficult to provide a facility for which artificial snow is used in an area where use of tap water is limited or where there is no source for water supply such as a river, ground water, or the like, and thus there is a problem that the area for provision of the facility is limited.

SUMMARY OF THE INVENTION

An object of the present invention is to provide a snow producing system capable of supplying artificial snow to a facility for which artificial snow is used without using a large amount of water.

To attain the above object, the main aspect of the present invention is a system comprising a facility for which snow is used, snow producing means for producing snow from water and supplying the snow to the facility, and means for supplying water made by melting of the snow supplied to the facility to the snow producing means as water used for producing snow.

According to such a system, since snow is again produced from meltwater and used, artificial snow can be supplied to the facility for which artificial snow is used without using a large amount of water. Thereby, the area capable of being provided with the facility for which artificial snow is used can be expanded.

These objects and still other objects and advantages of the present invention will become apparent upon reading the following specification when taken in conjunction with the accompanying drawings.

DETAILED DESCRIPTION OF THE PREFERRED EMBODIMENT

Figure 1:
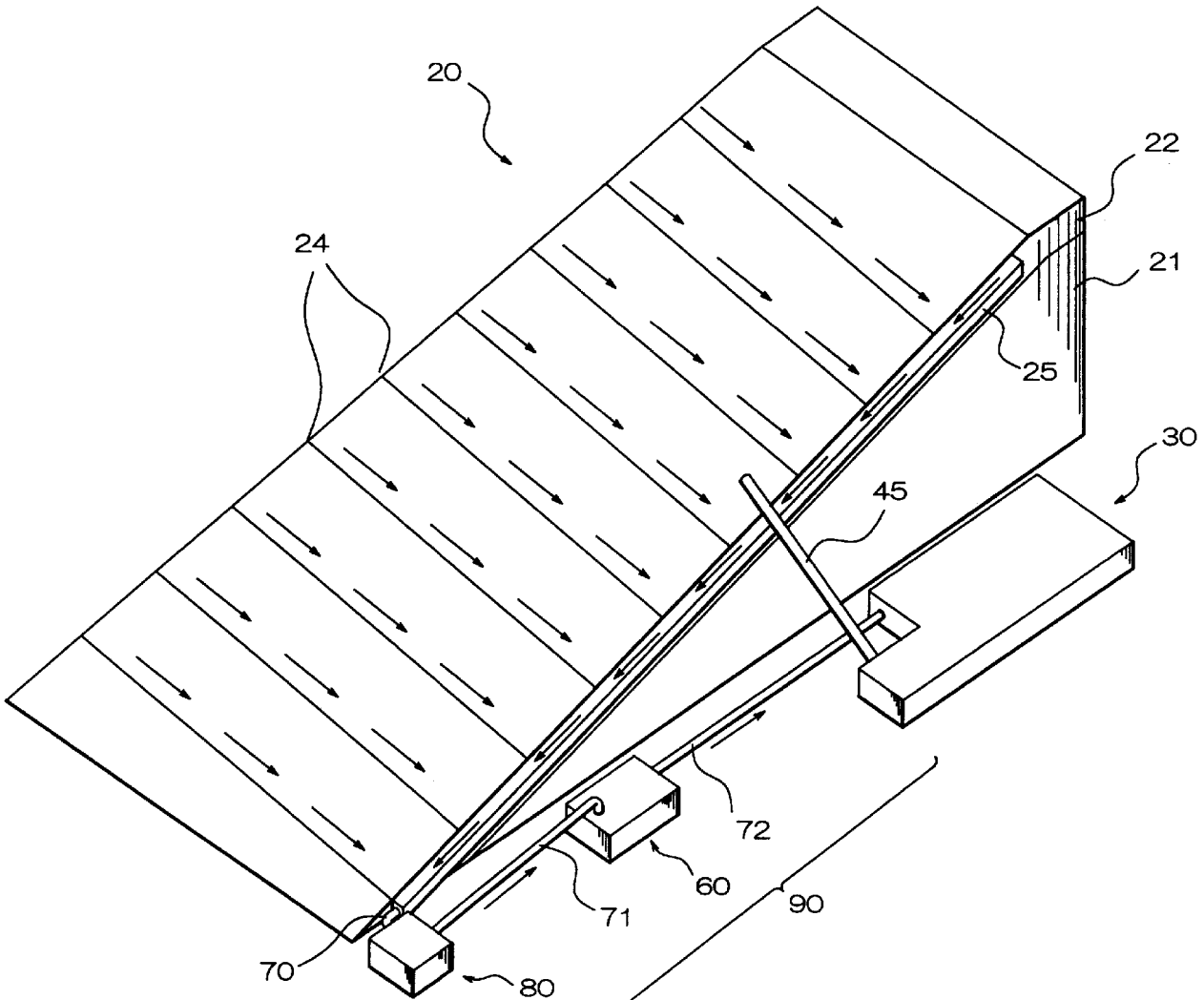
FIG. 1 is a view for explaining a snow producing system according to an embodiment of the present invention.

As shown in FIG.1, a snow producing system of this embodiment comprises a facility 20 for which snow is used, an ICS (Ice(Crushing) System) 30 as snow producing means for producing snow from water, and a supply section 90 for supplying meltwater to the ICS 30.

The supply section 90 supplies water made by melting of the snow supplied to the facility 20, that is, meltwater to the ICS 30 as water used for producing snow. The supply section 90 comprises a water storage section 80 in which meltwater is stored, a water clarification chamber 60 as clarifying means for clarifying meltwater, water supply piping 71 for supplying meltwater to the water clarification chamber 60 from the water storage section 80, and water supply piping 72 for supplying meltwater to the ICS 30 from the water clarification chamber 60.

Figure 8:
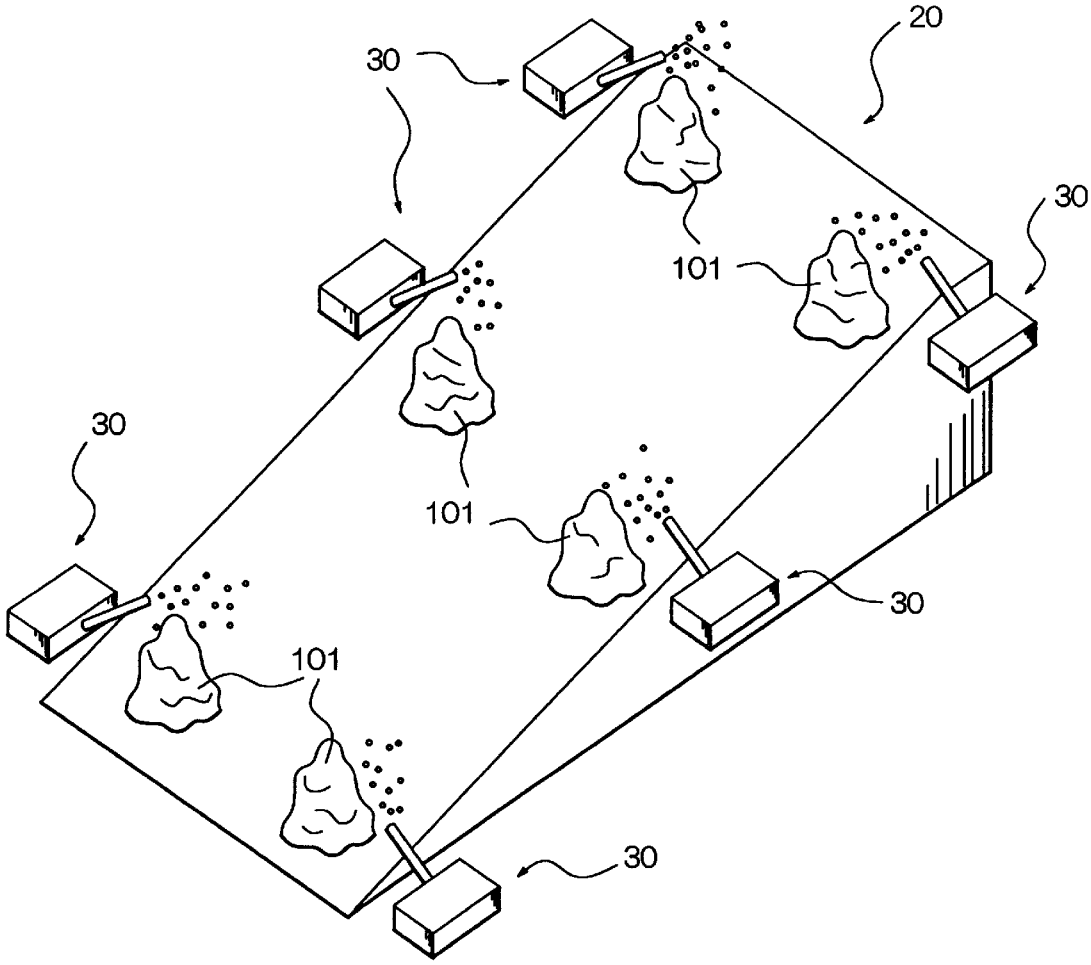
FIG. 8 is a view for explaining an example of a method for supplying snow over the entire facility.

As a method for supplying snow over the entire surface of the facility 20, the following method can be employed. A plurality of the ICSs 30 are provided on both sides of the facility as shown in FIG. 8. Heaps of snow 101 are formed partly on the facility 20 with the ICSs 30. Thereafter, the heaps 101 are spread over the entire surface of the facility 20 by a snow spreader, thereby forming a snow surface on the facility 20. Though only one ICS 30 is explained in this embodiment for an easy understanding, a plurality of ICSs 30 may be provided.

In this system, since meltwater is reused to produce snow, water can be effectively used. Accordingly, this system is effective for an area where the amount of water used for producing snow is limited. In a case where snow is supplied to a facility with no snow, since meltwater can not be used, it is preferable that water such as tap water, river water, ground water, living waste water used in facilities, or the like is used to produce snow so that the snow is supplied to the facility. Once snow is supplied to the facility, snow can be produced by reusing meltwater made from the snow supplied to the facility.

Next, the structure of the facility 20 of this embodiment will be described. The facility 20 has a structure for collecting meltwater and supplying it to the water storage section 80.

Figure 2:
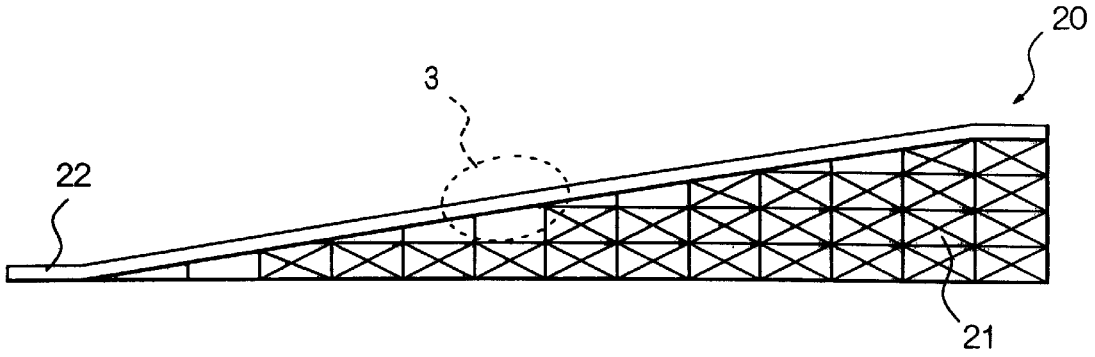
FIG. 2 is a diagrammatic view of a facility having an inclined surface.
Figure 4:
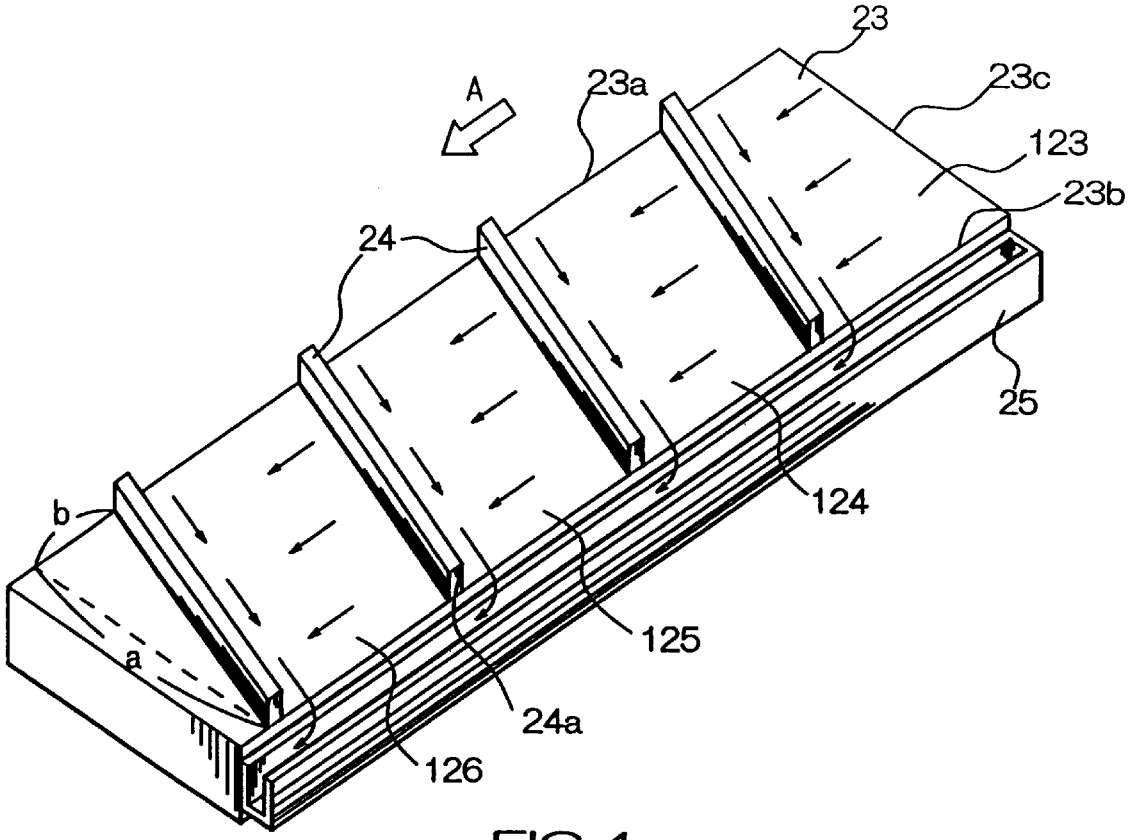
FIG. 4 is a perspective view of an impermeable floor and a water channel of the facility and a view for explaining a state where meltwater flows.

The facility 20 of this embodiment is used as a sliding facility, for example, for skis, a snowboard, a sled, and the like and has an inclined surface. As shown in FIG. 2, the facility 20 comprises a base 21 having an inclined surface of which the skeleton framework is formed with steel, and a sliding surface 22 disposed on the inclined surface of the base 21. As shown in FIG. 4, a floor 23 comprises a first side portion 23*b*, a second side portion 23*a* opposite to the first side portion 23*b*, and a top portion 23*c*. The facility 20 comprises a water channel 25 disposed along the first side portion 23*b* of the floor.

Figure 3:
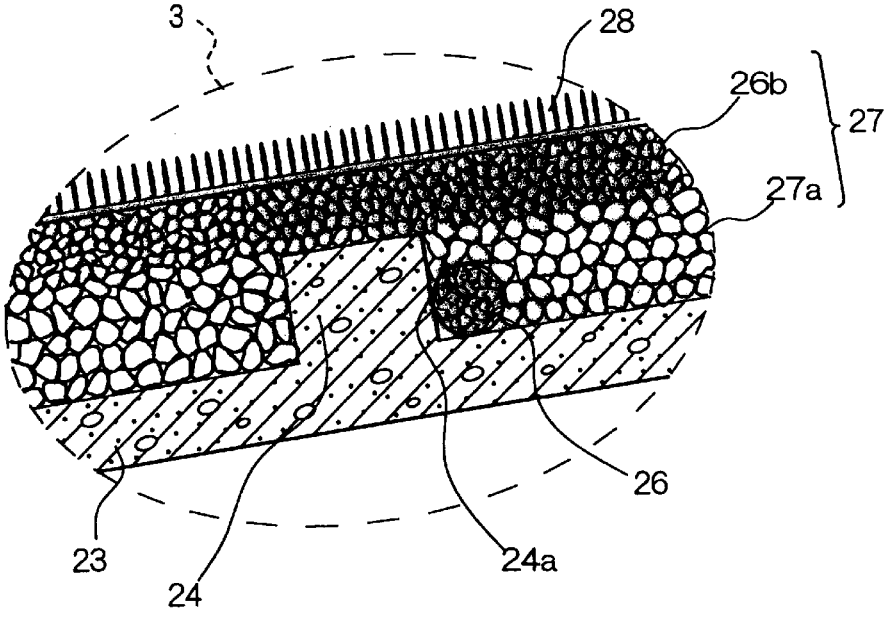
FIG. 3 is a partially enlarged sectional view of an area surrounded by an ellipse 3 in FIG. 2 and a view showing a structure around the inclined surface.

As shown in FIG. 3, the sliding surface 22 comprises the impermeable floor 23 made of concrete or the like, a permeable layer 27 disposed on the entire surface of the floor 23, and a snow mat 28 disposed in such a manner to cover the permeable layer 27. The snow produced by the ICS 30 is sprinkled on the snow mat 28.

The permeable layer 27 has a structure in which stones in different sizes are two-layered. Out of the two layers, a lower layer 26 consists of stones with a longitudinal diameter of about 4 cm to about 5 cm and an upper layer 27 consists of stones with a longitudinal diameter of about 10 mm to about 15 mm. These stones are put together in a stainless net into a block. A plurality of the blocks of stones are spread all over the floor 23, thereby forming the permeable layer 27. The snow mat 28 is permeable and a brush made of resin is formed on the surface thereof.

As shown in FIG. 3 and FIG. 4, a plurality of dams 24 are formed on the inclined surface of the floor 23 with a spaced gap of about 15 m between them. The dams 24 are formed integrally with the floor 23 and made of the same concrete as the floor 23. Each of the dams 24 is disposed from the first side portion 23*b* to the second side portion 23*a* and has a square pillar-shape of 20 cm in height and 30 cm in width. The dam 24 is formed nearly vertical in relation to the floor 23. The dam 24 is disposed on the floor 23 in such a manner that a side face 24*a* of the dam 24 on the top portion 23*c* side is positioned diagonally in relation to an inclined direction (a direction shown by an arrow A in FIG. 4) of the inclined surface. The downstream side of the inclination of the dam 24 is positioned on the first side portion 23*b* side where the water channel 25 is placed. The dam 24 is disposed in such a manner that when a right triangle in which the dam 24 is hypotenuse thereof is made, the ratio between two sides a and b across a right angle is expressed by a:b=50:1.

As shown in FIG. 4, the inclined surface of the floor 23 is separated into a plurality of regions 123 to 126 by the dams 24. The snow supplied to each of the regions 123 to 126 melts into water, and the meltwater is dammed by the dam 24 in each of the regions 123 to 126. The meltwater flows to the water channel 25 along the slanting dam 24. The arrows in FIG. 4 show the flow of the meltwater. The water flowing out into the water channel 25 passes through the water supply piping 70 and is stored in the water storage section 80 as shown in FIG. 1. Incidentally, FIG. 4 is different in size and the like of each component from FIG. 1 for understandably explaining the positional structure of the dams 24 and the flow of the meltwater.

Further, as shown in FIG. 3, a cylindrical filter 26 is disposed adjacent to the side portion 24*a* of each dam 24 along the dam 24. The filter 26 is made of a plurality of fibriform resins which are tangled and thus has a function of removing rubbish and the like mixed in meltwater. The filter is provided at each dam 24 as described above, thereby clarifying water to be supplied to the water storage section 80 in advance. The clarified water is again clarified by the water clarification chamber 60, thereby obtaining cleaner water as water used for producing snow.

As described above, since the sliding surface has a structure in which the permeable layer is disposed on the impermeable floor in this embodiment, meltwater passes through the permeable layer and comes to be supplied onto the impermeable floor. Accordingly, the snow on the front face of the sliding surface does not melt due to meltwater and resists melting, thus keeping a constant excellent state of snow.

Moreover, a plurality of the dams are provided on the floor and the water channel is further provided, thereby efficiently collecting meltwater over the floor. Furthermore, meltwater always flows out to the outside from the sliding surface along the dams 24, and therefore the state of the snow on the sliding surface can be kept excellent.

In this embodiment, each dam 24 has a square pillar-shape, but any shape can be applicable. It is preferable that the dam 24 has a structure which at least allows meltwater to be dammed and allows the meltwater to flow out to the outside from the sliding surface. Moreover, the shape of the filter 26 is not limited to the cylindrical shape. The filters 26 are preferably provided at least at the places in which meltwater flows. More preferably, the filters 26 are arranged at the places where meltwater dammed by the dams 24 becomes into puddles as in this embodiment, thereby efficiently performing clarification.

Figure 5:
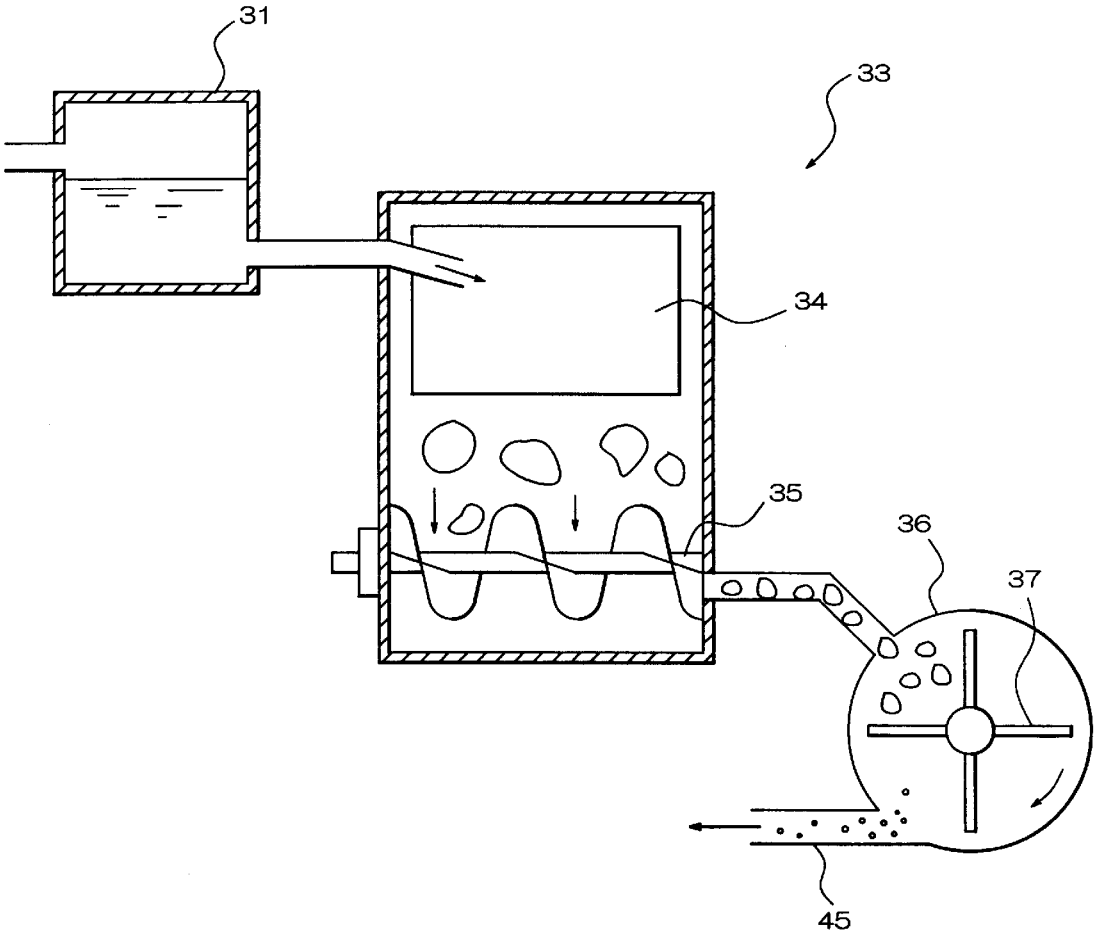
FIG. 5 is a view of an ICS (Ice(Crushing System) as snow producing means when seen from the top.

The ICS 30 is a system for producing snow from water and supplying the snow to the sliding surface 22. As shown in FIG. 5, the ICS 30 comprises a storage reservoir 31 in which water for a raw material of snow is stored, and a snow producing units 33.

The snow producing unit 33 comprises a cooling plate 34 for producing ice from water using a refrigerant, a screw conveyer 35 disposed under the cooling plate 34, and a crusher 36 disposed at an end of the screw conveyer 35.

In a state where the cooling plate 34 is kept at a temperature of, for example, about −15° C., water is supplied to the cooling plate 34 from the storage reservoir 31. Thereby, ice adheres to the surface of the cooling plate 34. Thereafter, hot gas at a temperature of +70° C. to +80° C. is allowed to flow on the cooling plate 34. Thereby, the ice adhering to the cooling plate 34 falls onto the screw conveyer 35. The ice which has fallen on the screw conveyer 35 is carried to the crusher 36. In the crusher 36, the ice is crushed by the rotation of a rotary crush blade 37 resulting in snow. The snow made by means of the snow producing unit 33 is supplied to the sliding surface through the snow carrying piping 45. It should be noted that to the storage reservoir 31, meltwater is supplied, but if there is no meltwater, tap water, ground water, river water, living waste water of facilities, or the like is supplied.

In this embodiment, since meltwater is utilized as water used for producing snow, the temperature of the water is low. Therefore, the cooling load of the snow producing unit 33 can be decreased, thus reducing costs.

Figure 6:
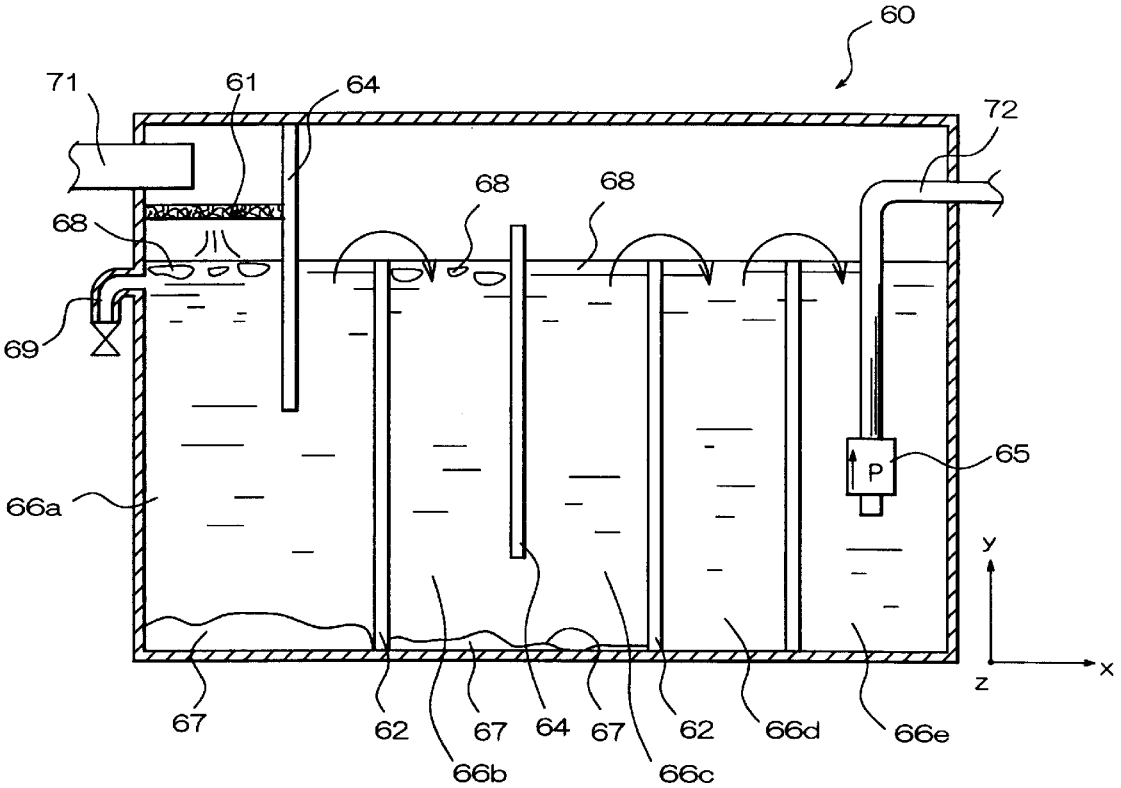
FIG. 6 is a vertically sectional view of a water clarification chamber as clarifying means.
Figure 7:
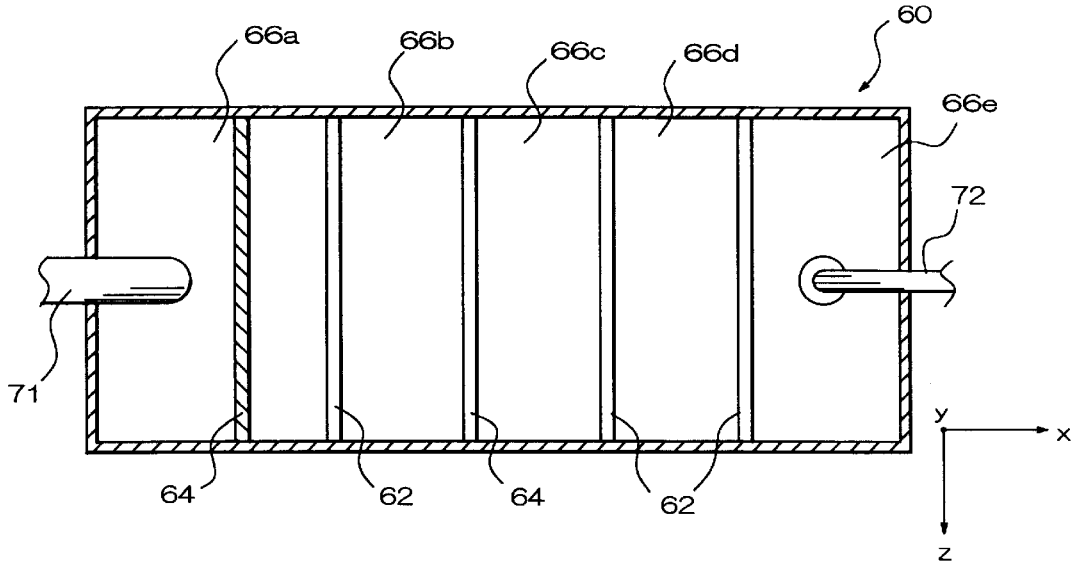
FIG. 7 is a diagrammatic view of the water clarification chamber as the clarifying means seen from the top.

Next, the water clarification chamber 60 will be explained using FIG. 6 and FIG. 7. FIG. 6 and FIG. 6 are both views of the water clarification chamber. FIG. 6 is a vertically sectional view of the water clarification chamber. FIG. 7 is a diagrammatic view of the water clarification chamber in FIG. 6 seen in a Z-direction from the top.

The water clarification chamber 60 is a unit for clarifying meltwater. Rubbish, mud, wax adhering to the surface of skis and snowboards, and the like are mixed in meltwater. Therefore, if the meltwater in the as-is status is used to producer snow, polluted snow is occasionally produced, which exerts a bad influence on the human body and an environment. In this embodiment, meltwaer is subjected to clarification in order to produce clean snow.

As shown in FIG. 6, the water clarification chamber 60 comprises a plurality of walls 64 and 62, a filter 61, and a pump 65 used for supplying the clarified water to the outside of the water clarification chamber 60 all of which are arranged therein. In the water clarification chamber 60, meltwater 68 is stored.

The inside of the water clarification chamber 60 is separated by the walls 62 and 64 provided at the bottom and the inner wall of the water clarification chamber 60 into a plurality of rooms 66*a*, 66*b*, 66*c*, 66*d*, and 66*e* which communicate with each other at the top portions thereof as shown in FIG. 6 and FIG. 7. Moreover, the room 66*a* is separated by the wall 64 provided at the ceiling portion of the water clarification chamber 60 into two rooms which communicate with each other at the bottom portions thereof. In other words, the inside of the room 66*a* is in a state of being separated by the wall 64 into two spaces at the top portion thereof. The rooms 66*b* and 66*c* are separated by the wall 64 and communicate with each other at the bottom portions thereof.

The meltwater stored in the water storage section 80 is supplied into the water clarification chamber 60 through the water supply piping 71. The meltwater has been removed passes through the filter 61 in which a plurality of layers made of tangled fibriform resins are laminated, and thereby rubbish and the like in the water are removed.

Next, when an oil content such as wax is mixed in the meltwater from which rubbish and the like have been removed, an oil content 68 comes to float on water as shown in FIG. 6. The room 66*a* is separated by the wall 64 into two spaces at the top portion thereof, and therefore the oil content 68 staying in one space never passes across the wall 64 to move to the other space. The oil content 68 is drained out of the water clarification chamber by a drainage pipe 69 provided at the water clarification chamber 60. The drainage pipe 69 is opened and closed by valve. Thereby, the oil content 68 can be removed from meltwater.

Mud and rubbish 67 which could not have been removed by the filter 61 precipitate to the bottom of the room 66*a*. Thus the upper layer portion of the water which has passed through the filter 61 is in a state where mud and rubbish are not mixed therein. Moreover, the upper layer portion of the water moves to the adjacent room 66*b* over the wall 62. Also to the bottom of the room 66*b*, the mud and rubbish 67 precipitate. When the oil content which could not have been removed is mixed in the water, the oil content 68 comes to float on water in the room 66*b*. The upper layer portion of the water in the room 66*b* never passes across the wall 64 move to the room 66*c*, therefore the oil content 68 staying in the room 66*b* never move to the room 66*c* and the water from which has been removed the oil content moves to the room66c. Mud and rubbish 67 which are mixed in the water precipitate to the bottom of the rooms 66*b* and 66*c*. The upper layer portion of the water in the room 66*c* moves to the adjacent room 66*d* over the wall 62. As described above, the meltwater step by step moves from one room to another which are separated by the walls 62 and 64, and thereby cleaned water is stored in the last room 66*e*. The cleaned water, stored in the room 66*e* is drawn up by the pump 65 and supplied to the storage reservoir 31 of the ICS 30 through the water supply piping 71.

In this embodiment, snow is produced using meltwater subjected to the clarification processing, and therefore clean snow can be obtained. Accordingly, there are no problems of environmental destruction and influence exerted upon the human body due to polluted snow. Moreover, the water clarification chamber is provided, thereby using, for example, living waste water or the like instead of meltwater, resulting in that water can be effectively utilized. Furthermore, even if snow does not need to be produced, the water cleaned by the water clarification chamber can be drained as it is, which never destroys an environment.

Though the facility with an inclined surface is taken as an example in this embodiment, the present invention can be also applied to a facility having a level surface. In this case, as a collecting method of meltwater, for instance, it is preferable that a groove with inclination is provided in a floor, and using the groove as a water passage, the meltwater which has passed through the groove flows out to a water channel provided adjacent to the facility.

The aforesaid embodiments have the intention of clarifying technical meaning of the present invention. Therefore, the present invention is not intended to be limited to the above concrete embodiments and to be interpreted in a narrow sense, and various changes may be made therein without departing from the spirit of the present invention and within the meaning of the claims.

What is claimed is:

1. A system comprising:

a facility for which snow is used;

snow producing means for producing snow from water and supplying the snow to said facility; and means for supplying water made by melting of the snow supplied to said facility to said snow producing means as water used for producing the snow, wherein said facility comprises an impermeable floor further comprising an inclined surface, a permeable layer being disposed on said inclined surface and being supplied with the snow by said snow producing means, said inclined surface having an inclined direction, wherein said impermeable floor comprises a fust side portion and a second side portion opposite to said first side portion, wherein said facility further comprises a water channel disposed along said first side portion, wherein said impermeable floor comprises a plurality of dams, each of said dams comprising a side portion and a downstream portion, said side portion being diagonally positioned in relation to said inclined direction of said inclined surface, said downstream portion being positioned on said first side portion of said impermeable floor.

2. The system as set forth in claim 1, wherein said facility further comprises a filter, disposed adjacent to said side portion of each of said dams and along each of said dams, for filtering the water.

3. The system as set forth in claim 1, wherein said snow producing means comprises:

means for freezing the water so as to produce ice; and means for crushing the ice so as to produce snow.

4. The system as set forth in claim 1, wherein said supply means includes:

a water storage section for storing water made by melting of the snow; and means for clarifying water stored in said water storage section.

5. The system as set forth in claim 4, wherein the clarifying means includes a filter for filtering the water.

6. The system as set forth in claim 4, wherein the clarifying means includes a water clarification chamber in which walls are arranged being separated by the walls into a plurality of rooms which communicate with each other at the top portions thereof.

7. The system as set forth in claim 4, wherein the clarifying means includes a water clarification chamber in which walls are arranged being separated by the walls into a plurality of rooms which communicate with each other at the bottom portions thereof.

* * * * *